US006244458B1

(12) United States Patent
Frysinger et al.

(10) Patent No.: US 6,244,458 B1
(45) Date of Patent: Jun. 12, 2001

(54) THERMALLY INSULATED CONTAINER

(75) Inventors: Clinton Frysinger, Westerville; James Graber, Columbus; Dwight Musgrave, Granville; Linda Siders, Reynoldsburg; Gregory Thune, Westerville, all of OH (US); Dorothy J. Muffett, Plymouth, MN (US); Joseph Lehman, Columbus, OH (US)

(73) Assignee: Thermo Solutions, Inc., Minneapolis, MN (US)

( * ) Notice: Subject to any disclaimer, the term of this patent is extended or adjusted under 35 U.S.C. 154(b) by 0 days.

(21) Appl. No.: 09/347,663

(22) Filed: Jul. 6, 1999

Related U.S. Application Data

(60) Provisional application No. 60/092,209, filed on Jul. 9, 1998.

(51) Int. Cl.[7] ..... F25D 23/00

(52) U.S. Cl. ..... 220/592.09; 220/592.1; 220/592.2; 220/592.25

(58) Field of Search ..... 220/592.09, 592.1, 220/592.2, 592.25, 592.26

(56) References Cited

U.S. PATENT DOCUMENTS

| | | | | |
|---|---|---|---|---|
| 1,701,323 | * | 2/1929 | Fredenhagen | 220/592.09 |
| 1,797,265 | * | 3/1931 | Klopsteg | 220/592.09 |
| 2,019,194 | * | 10/1935 | Munters | 220/592.1 |
| 2,304,757 | * | 12/1942 | Arthur | 220/592.09 |
| 2,484,310 | * | 10/1949 | Philip | 220/592.09 |
| 2,817,123 | * | 12/1957 | Jacobs | 220/592.09 |
| 2,969,164 | * | 1/1961 | Morrison | 220/592.2 |
| 5,032,439 | * | 7/1991 | Glicksman et al. | 428/44 |
| 5,316,171 | * | 5/1994 | Danner, Jr. et al. | 220/592.21 |
| 5,512,345 | * | 4/1996 | Tsutsumi et al. | 428/69 |
| 5,816,432 | * | 10/1998 | Hammen et al. | 220/530 |
| 5,918,478 | * | 7/1999 | Bostic et al. | 62/371 |
| 5,950,450 | * | 9/1999 | Meyer et al. | 62/457.9 |

* cited by examiner

*Primary Examiner*—Paul T. Sewell
*Assistant Examiner*—Troy Arnold
(74) *Attorney, Agent, or Firm*—Kinney & Lange, P.A.

(57) ABSTRACT

A container has a base, peripheral walls and a lid. Each of the base, peripheral walls and lid includes an interior wall spaced from an exterior wall, with vacuum panel in between. The sides of the vacuum panels are covered by compressible insulation fill, minimizing thermal flow along the vacuum panels despite any manufacturing tolerance differences in the width of the vacuum panels as compared to the distance between the interior wall and the exterior wall. The interior wall of the body of the container is provided by a liner formed of a single, deep drawn sheet of material. The exterior wall is similarly formed as a deep drawn shell. The inner liner and the outer shell are welded together with a bead to encase the vacuum panels in a water-tight manner, with the liner, the shell the bead all formed of the same material.

20 Claims, 4 Drawing Sheets

THERMALLY INSULATED CONTAINER

CROSS-REFERENCE TO RELATED APPLICATION(S)

The present application claims priority from Provisional Application Serial No. 60/092,209, filed Jul. 9, 1998, entitled ACE CONTAINER.

BACKGROUND OF THE INVENTION

The present application relates to thermally insulated containers, and, more particularly, to thermally insulated containers which use vacuum panels as a primary mechanism to avoid thermal loss. Such thermally insulated containers can be used for maintaining food, drink or medical items in a cold or frozen state without an outside energy or cooling source.

Containers such as coolers have long been used to thermally insulate hot items or frozen or refrigerated items. Many items which are frozen or refrigerated are perishables such as food items which must be maintained at a cold or frozen temperature to satisfactorily inhibit bacteria growth. The coolers typically contain walls made out of a thermally insulated material, such as a closed cell foam (for example, STYROFOAM) or other thermally insulating material. For repeated use in conjunction with food items, the thermal insulation layer is commonly housed in a more durable, sanitary housing structure, such as plastic, aluminum or stainless steel sheet material as layers on the inside and/or outside of the thermal insulation layer. Such coolers usually include a relatively flat base, generally vertical peripheral walls, and a removable lid which together form an enclosure. Each of the base wall, peripheral walls and lid may be thermally insulated.

The coolers are generally wide-mouthed, with the lid being approximately the same size as the base, with the lid extending across the wide mouth. With the wide-mouthed construction, items placed in the cooler may be as large as the insulated chamber, because no neck is present to interfere with placement or removal of the items into or out of the cooler.

In some instances the thermal insulation layer is provided by a vacuum between two spaced wall layers. For instance, vacuum insulated containers may come in the form of a circularly drawn vacuum bottle. Vacuum bottles are usually constructed with a small opening or neck, and are intended for holding liquid. Vacuum bottles are not commonly used to hold solid items such as perishable food items, because the neck is too small for the food items to pass.

Vacuum insulation has also been available in a second form, as planar vacuum panels. A container constructed of planar vacuum panels would likely include six separate side walls joined to form a cubical or box shape, including twelve edges connected between the six sides of the vacuum panels. Such containers have a primary thermal difficulty, referred to as "edge loss", which must be overcome. In particular, while the panels themselves are very efficient thermal insulators, the edges between panels can contribute to thermal losses which are more significant than the thermal efficiency provided by the panels themselves. Because of edge loss problems and cost of manufacture, vacuum panels have not gained widespread acceptance for use in container walls.

It has also been long recognized that the thermal insulation provided by coolers may not always be sufficient to maintain the cold state of a product over a prolonged period of time. For this reason, various coolant materials have been used in conjunction with the thermally insulated containers. The most basic and common coolant material is ice, which melts at 32° F. or 0° C. with a latent heat of fusion of approximately 80 cal/g, or approximately 333 kJ/kg. The melting phase change of the ice (i.e., the heat absorbed by the ice during melting) maintains the perishable goods near the melting temperature of ice.

One shortcoming of ice is that the result of the phase change is water, and many of the frozen or refrigerated goods should be maintained in a dry state and not exposed to contact with water. Other coolant materials may be poisonous or have harmful effects if ingested, making it even more important that the coolant material does not contact a food item. For this reason, water and other water-based coolant materials have been enclosed in various coolant packets, such as rigid or semi-rigid plastic containers. Another shortcoming of ice is that ice melts at a temperature which is too high to maintain most food items in a frozen state. Thus, ice is a suitable coolant material for refrigerated goods, but not for frozen goods.

Frozen carbon dioxide, or "dry ice", is a commonly used coolant material for frozen goods. Dry ice has a higher latent heat, and a lower phase change temperature than water. Carbon dioxide undergoes a phase change from solid to gas at approximately −78.5° C. or −110° F., with a latent heat of sublimation of about 573 kJ/kg. Skin contact to dry ice is somewhat hazardous, and dry ice should generally be handled without skin contact.

Regardless of the use of coolant materials, the various shortcomings of suitable thermally insulative containers have limited their use in many potential applications. Additional mechanical or thermal means of cooling (i.e., freezers, refrigerated trucks and box cars, etc.), at a significant expense, are often required for handling of frozen items. Additional methods are needed for the handling of frozen items in a warm or ambient for periods of time ranging from several minutes to hours to several days.

BRIEF SUMMARY OF THE INVENTION

The present invention involves a thermally insulated container including vacuum panels positioned between an interior liner and an exterior shell. One or more sides of the vacuum panels are covered by compressible thermal insulation, i.e., between the vacuum panels and the interior liner and/or exterior shell. The compressible thermal insulation layer limits thermal flow along the walls, which in turn decreases the edge losses due to thermal flow into/out of the container between vacuum panels. In one aspect, the liner and the shell are welded together with a bead to encase the vacuum panel in a water-tight manner, with the liner, the shell and the bead all formed of the same material.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
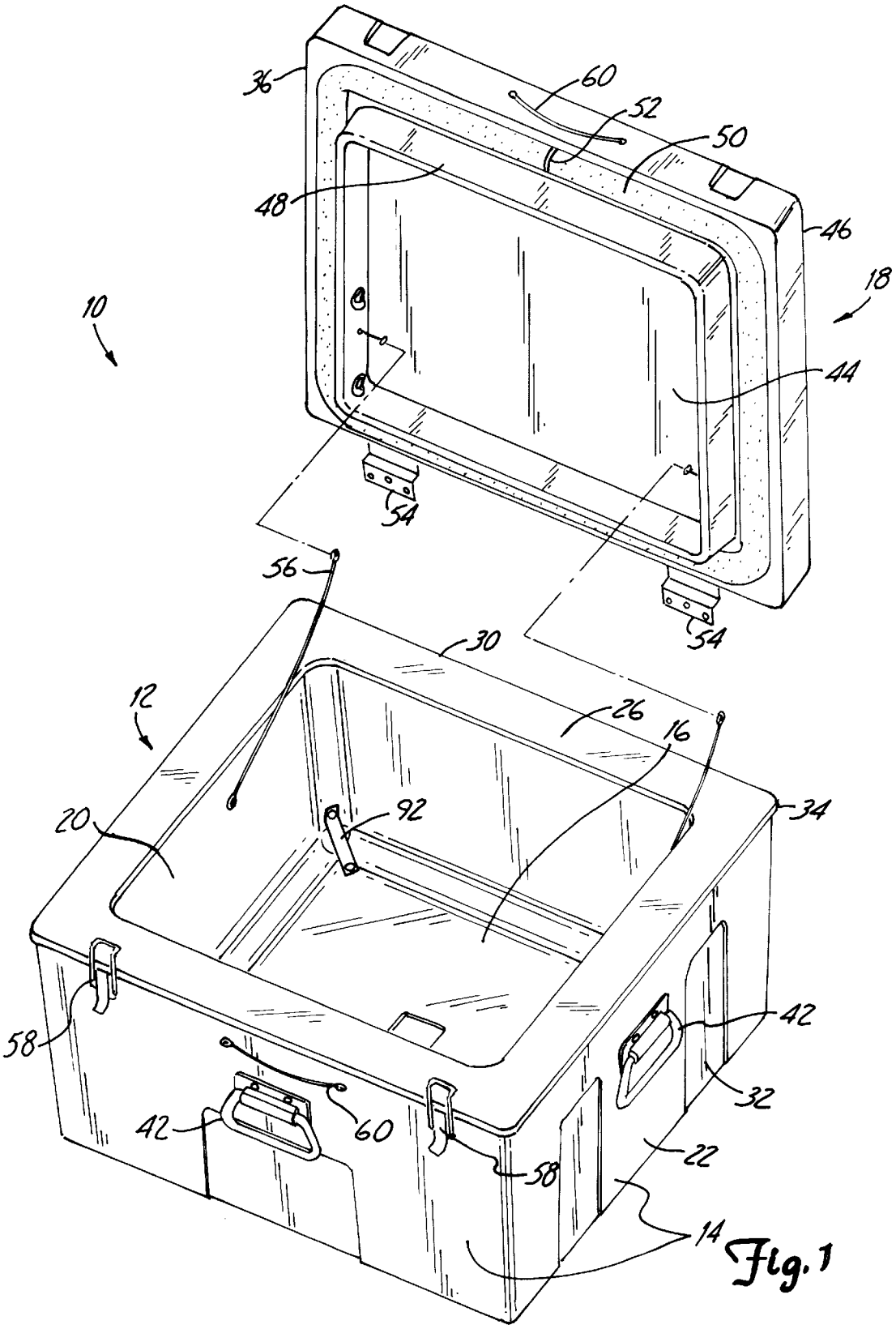
FIG. 1 is a perspective view of the container of the present invention with the lid open.

A container 10 as shown in FIG. 1 generally includes a body 12 having a bottom wall or base 16, peripheral side walls 14 extending upward from the base 16 to form an enclosure with an opening, and a top wall or lid 18. The base 16, the side walls 14 and the lid 18 are all thermally insulated, and a substantial thickness is required to provide the desired degree of insulation and rigidity. For instance, the base 16, the side walls 14 and the lid 18 may each be 1 or 2 inches thick. The size of the container 10 may be selected according to its desired use. In one embodiment, the enclosure is about 2300 cubic inches.

All of the side walls 14 of the preferred embodiment are rectangular to produce a container 10 having a box-like shape, but other shapes could alternatively be used. However, the rectangular box like shape of the present invention is particularly beneficial for stacking of multiple containers 10 side-by-side and one atop another.

The body 12 of the container 10 includes an inner liner 20 on its interior side and an outer shell 22 on its exterior, with thermal insulation 24 (described in detail below with reference to FIGS. 2–4) in the space between the inner liner 20 and the outer shell 22. The inner liner 20 includes a lip 26 which extends outward over the thickness of the thermal insulation 24 in the side walls 14. For instance, the lip 26 may extend about 1 or 2 inches outward. The lip 26 mates against the lid 18, and in the preferred embodiment the lip 26 provides a horizontal, flat surface. The inner liner 20 terminates at an edge 30 which preferably turns downward from the lip 26. For instance, the edge 30 may extend downward such as a quarter of an inch from the lip 26. The edge 30 is used to secure the inner liner 20 and the outer shell 22. By having the edge 30 extend downward, the edge 30 between the inner liner 20 and the outer shell 22 is removed slightly from the junction between the body 12 of the container 10 and the lid 18.

Slight ridges or indentations 32 may be formed into one or both of the outer shell 22 and the inner liner 20. These indentations 32 assist in increasing rigidity of the inner liner 20 and outer shell 22, reducing the potential for buckling or unwanted deformation of the inner liner 20 and outer shell 22 during use of the container 10.

The inner liner 20 is preferably integrally formed from a single piece of material. For instance, the inner liner 20 may be deep drawn from a flat sheet of thermoplastic material. If the inner liner 20 and the lip 26 are separate pieces, the lip 26 may be made of thermoplastic material, and the remainder of the inner liner 20 may be made of metal. By being integrally formed, the inner liner 20 provides an interior side of both the base 16 and the side walls 14, without any thermal discontinuity in the inner liner 20 between the base 16 and the side walls 14. Similarly, the outer shell 22 is preferably integrally formed from a single piece of material to provide no thermal discontinuity in the outer shell 22 between the base 16 and the side walls 14.

The inner liner 20 and the outer shell 22 may have a slight draft to assist in the deep drawing formation process, such as a draft on the order of a few percent. The draft on the inner liner 20 is preferably the same as the draft on the outer shell 22, so the inner liner 20 of each side wall 14 is parallel to its outer shell 22. This allows a generally uniform thickness to the thermal insulation 24 in the side walls 14.

The inner liner 20 has a wall thickness sufficient for substantial rigidity, although some limited deformation flexibility is preferred. The wall thickness of the inner liner 20 allows it to withstand significant wear and tear without permanent deformation. For instance, the inner liner 20 may have a wall thickness of about 0.05 to 0.25 inches, depending upon material. This thickness should be minimized, particularly at the lip 26, so as to minimize the amount of thermal conduction which occurs along the inner liner 20 particularly as contributing to edge loss. The outer shell 22 is preferably thicker and stronger than the inner liner 20, as the outer shell 22 may undergo substantial abuse during use. A thicker outer shell 22 provides for a more rugged container 10 during handling (or mishandling) of the container 10. For instance, in a preferred embodiment, the inner liner 20 may have a wall thickness of 1/16 of an inch, while the outer shell 22 may have a wall thickness of about 1/8 of an inch.

The outer shell 22 and the inner liner 20 should be joined at the edge 30 forming a water-tight seal. In the preferred embodiment, the water-tight seal is provided by a bead weld 36 of material which is thermally welded at the edge 30. By having a water tight seal, humidity or moisture build-up in the side walls 14 is prevented. Dryness between the outer shell 22 and the inner liner 20 maintains the full thermal insulation benefits of the container 10, as well as minimizing weight and minimizing the potential for bacterial growth.

The material of the container 10, and particularly the material of the inner liner 20 which may be in contact with a coolant material (not shown), should not become brittle even at very cold temperatures. In this way, the inner liner 20 will not crack or shatter if the container 10 is dropped during use.

The outer shell 22 and the inner liner 20 are preferably formed of the same material, or by materials having similar coefficients of thermal expansion. If a bead weld 36 is used to seal the outer shell 22 and the inner liner 20 together, the bead weld 36 should also be formed of the same material or a material having the same melt temperature. The difference between ambient conditions and the container interior may be 100° F. or more. While the inner liner 20 maintains a fairly steady temperature profile during use of the container 10, the temperature differential of cycling from storage to steady state use is significant. By having the outer shell 22, the inner liner 20 and the bead weld 36 (if present), formed of the same material, thermal cycling of the container 10 does not create thermal expansion induced stress at the bead weld 36 or other sealed joint between the inner liner 20 and the outer shell 22. The lack of thermal expansion induced stress at the bead weld 36 increases longevity of the water-tight seal provided by the bead weld 36.

Locating the bead weld 36 outside the junction 40 between the side walls 14 and the lid 18 provides several advantages. First, this location will stay near ambient temperature during use of the container 10, thus minimizing thermal cycling at the bead weld 36. Second, any unevenness in the bead weld 36 will not form part of the junction 40 between the lid 18 and the body 12 of the container 10, so the junction 40 between the lid 18 and the body 12 can be as even as possible. Third, the bead weld 36 is typically of greater thickness than the inner liner 20 and lip 26, and thus thermal conduction occurs faster at the bead weld 36 than along the inner liner 20. Locating the bead weld 36 outside the junction 40 between the side walls 14 and the lid 18 keeps this increase thermal conduction from significantly contributing to edge loss.

The inner liner 20 and the outer shell 22 may be formed of metal such as stainless steel, but are more preferably formed of a thermoplastic material having a lower coefficient of thermal conduction than metals. A low coefficient of thermal conduction is particularly important along the lip 26 (where the material extends outward from the enclosure). If a metal inner liner is used, the lip 26 should be formed separate from the remainder of the inner liner 20 and of a non-metal material. Preferred thermoplastic materials include polycarbonate, polystyrene and glass-filled nylon, with the most preferred material being high density polyethylene ("HDPE").

Handles 42 may be provided along the outside of the container 10. In the preferred embodiment, three handles 42 are provided, one on each unhinged side wall 14. The preferred handles 42 hinge outward to an extended position for lifting and inward to a position parallel with the side walls 14 to minimize the possibility of damage and to minimize the space necessary for container storage.

The lid 18 for the container 10 may be formed similarly to the body 12 of the container 10, including a lid liner 44 and a lid shell 46 with thermal insulation 24 between the lid liner 44 and lid shell 46. The preferred container 10 includes a lid liner 44 which is drawn from high density polyethylene with a material thickness of about 1/16 inch, and a lid shell 46 which is drawn from high density polyethylene with a material thickness of about 1/8 inch. The lid liner 44 is attached to the lid shell 46 with a high density polyethylene bead weld 36 that provides a water-tight seal. The bead weld 36 is located just outside the junction 40 between the lid 18 and the body 12 of the container 10.

The lid liner 44 preferably includes a dam 48, sized to be received in the enclosure of the inner liner 20. The dam 48 extends a substantial distance downward into the enclosure. For instance, the dam 48 may extend approximately 1½ inch downward into the enclosure. The dam 48 and the inner liner 20 have a slight flexibility, and a slight interference fit between the dam 48 and the inner liner 20 allows for a snug (but not pressure-tight) seal between the dam 48 and the inner liner 20. The dam 48 is thermally insulative and helps to minimize thermal loss through the junction 40 between the lid 18 and the body 12 of the container 10.

To the outside of the dam 48, a gasket 50 is provided to increase the thermal insulation efficiency at the junction 40 between the lid 18 and the body 12 of the container 10. The gasket 50 is preferably formed in a tubular shape so as to provide maximum compressibility. The gasket 50 maybe formed for example from ethylene-propylene-diene monomer ("EPDM") with an adhesive back, allowing for adhesive attachment of the gasket 50 to the lid 18.

The preferred gasket 50 is not continuous, but rather includes a pressure release separation 52. The pressure release separation 52 may be simply provided by aligning and abutting (but not joining) ends of the gasket 50 together. The pressure release separation 52 provides an outlet for gases within the container 10 if the pressure differential between the container 10 and atmosphere exceeds a desired maximum value. In particular, the container 10 is intended to be used with a coolant material 38 which expands volumetrically such as when dry ice evaporates into carbon dioxide. The gasket 50 prevents any non-pressurized airflow into or out of the container 10, but a pressure differential such as 0.1 or 0.2 atmospheres will cause the gasket 50 to slightly open at the pressure release separation 52 to allow carbon dioxide to escape from the container 10.

The pressure release separation 52 permits pressure release both into as well as out of the container 10. For instance, when transported by airplane, the cargo compartment of the airplane may depressurize during the flight. Because of the pressure release separation 52, the enclosure will similarly depressurize. If pressure is not permitted back into the container 10, the lid 18 may be impossible to remove from the body 12 of the container 10. The pressure release separation 52 allows substantial repressurization of the container 10 when the cargo compartment of the airplane repressurizes.

If desired, the lid 18 may be entirely separable from the body 12 of the container 10. However, the preferred lid 18 is hinged to the body 12 of the container 10. For instance, the lid shell 46 may be attached to the outer shell 22 of the container 10 with two spaced hinges 54.

A lanyard 56 may be used to prevent the lid 18 from pivoting too far open on the hinge and to allow the lid 18 to rest in an upward, open position without tipping of the container 10. The lanyard 56 is attached at one end to the inner liner 20 and at the other end to the lid liner 44. The lanyard 56 may be for instance a vinyl coated flexible wire cable. The attachment of the lanyard 56 to the inner liner 20 should be at depth greater than the dam 48 so that the lanyard 56 does not interfere with the mating of the dam 48 into inner liner 20 when the container 10 is closed. Latches 58 may be provided for securing the lid 18 in a closed position. Straps 60 may be attached to the lid shell 46 and the outer shell 22 so the container 10 may be easily locked such as with a tamper-evident lock (not shown).

As mentioned previously, the inner liner 20 and the outer shell 22 should provide a watertight seal for the thermal insulation 24. To this end, the handles 42, hinges 54, lanyard 56, latches 58 and straps 60 should be secured to the shells 22,46 with a water-tight attachment. For example, adhesive attachments or welded attachments may be used. In the preferred embodiment, closed end rivets and/or threaded fasteners are screwed into threaded metal backing plates with insert weld nuts are used in attaching components to the shells 22,46 in a sealed manner.

Figure 2:
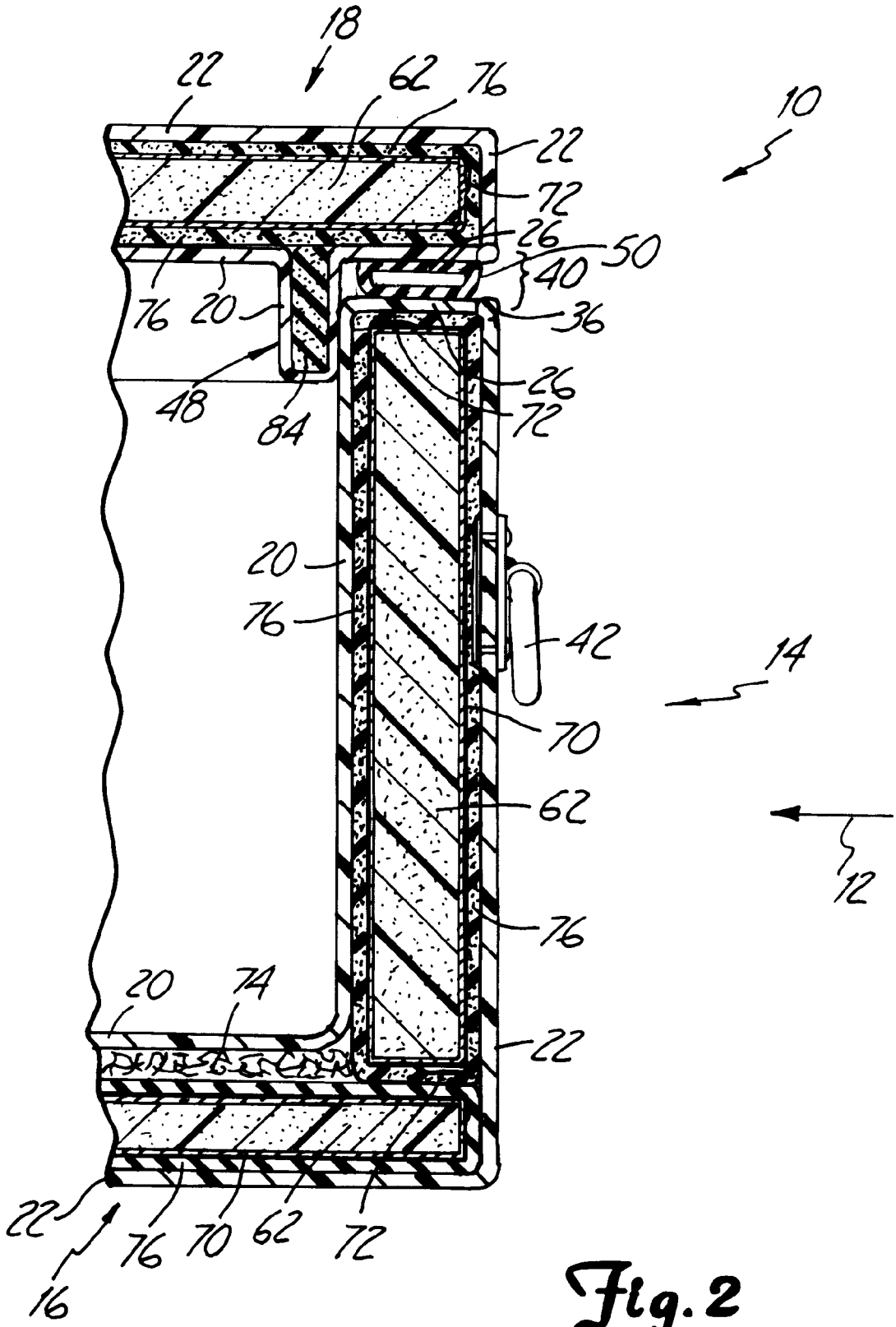
FIG. 2 is a cross sectional view of a side wall of the container of FIG. 1 with the lid closed.
Figure 3:
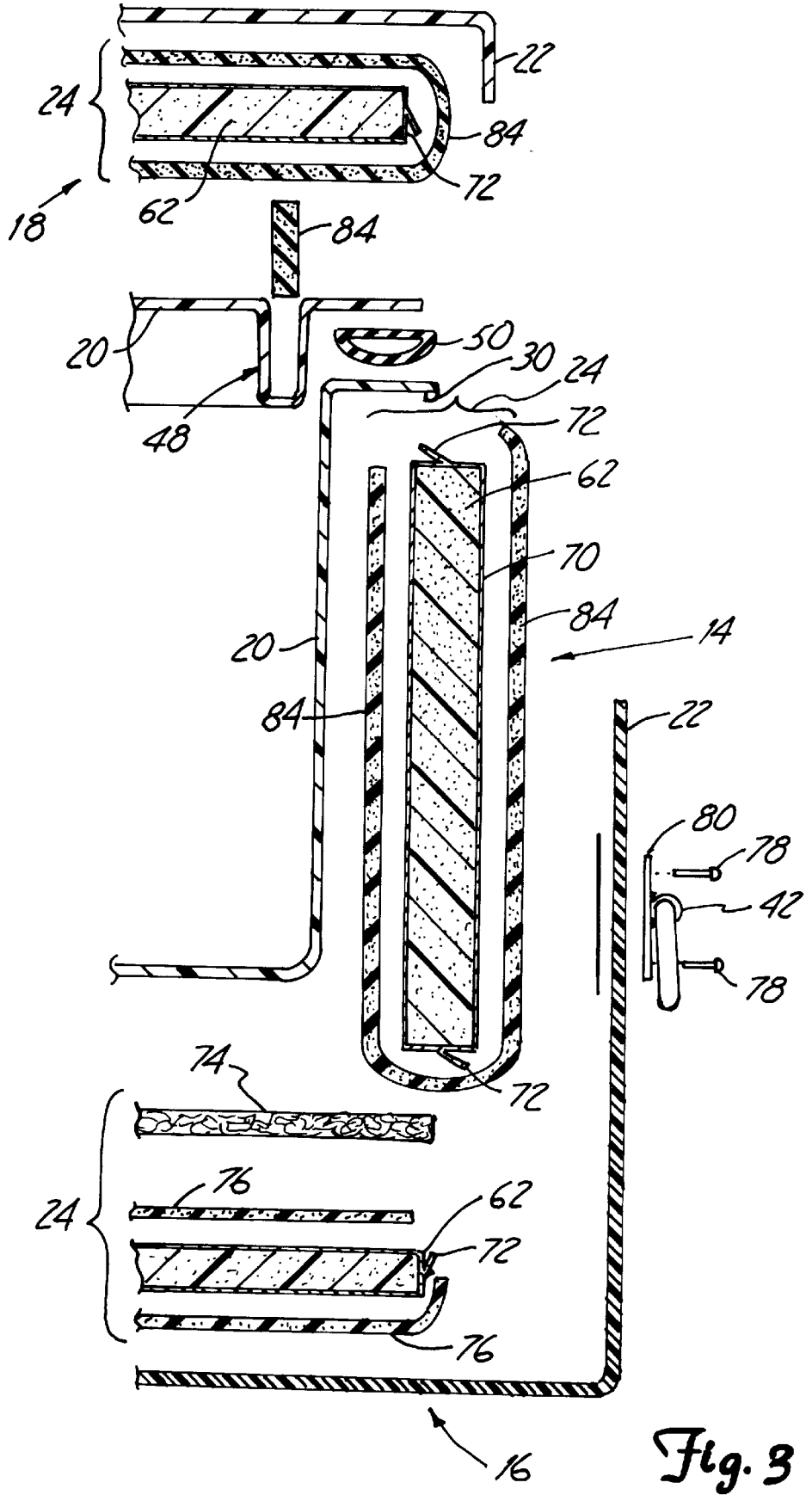
FIG. 3 is an exploded cross sectional view of FIG. 2 showing assembly of the container of FIG. 1.
Figure 4:
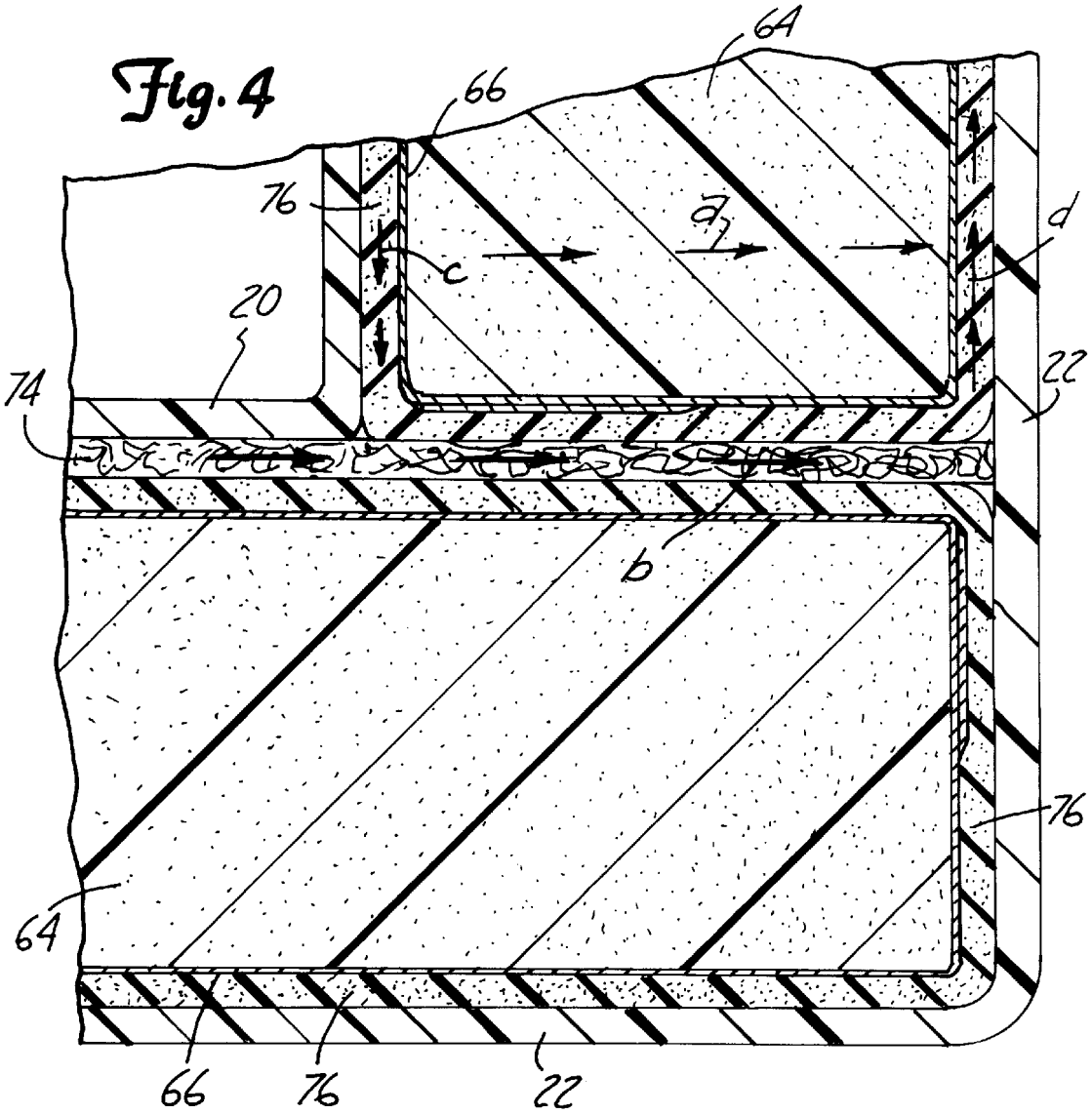
FIG. 4 is an enlarged portion of FIG. 2 showing a cross sectional view of a bottom corner of the container of FIG. 1.

As shown in FIGS. 2–4, vacuum panels 62 are used to provide the primary thermal insulation between the inner liner 20 and outer shell 22. In the base 16, the side walls 14 and the lid 18, the thickness of the vacuum panels 62 is selected to roughly match the space between the outer shell 22 and the inner liner 20. For instance, the vacuum panels 62 may nominally be one or two inches thick.

Each vacuum panel 62 consists of a permeable medium (foam or powder) filler 64, encapsulated with a film laminate barrier material 66, which has been sealed and evacuated below atmospheric pressure. In its evacuated state, a flexible barrier film 66 is sealed around the porous medium 64. The barrier film 66 retains the evacuated condition for the life of the vacuum panel 62. To render the container 10 more portable, the porous medium 64 should be lightweight. One preferred porous medium 64 is rigid polystyrene foam available from Dow Chemical Co. of Midland, Mich. as INSTILL foam. Other permeable media include silica, fiberglass and urethane. For high performance vacuum panels 62, the panels may be evacuated to about 5 Torr or less. In the preferred embodiment, the vacuum panels may be evacuated to between 1.0 and 0.001 Torr. The barrier film 66 must be able to hold the low vacuum pressure for a prolonged period of time, and may be a multiple layer hermetic film. Suitable high performance barrier film to retain this low vacuum pressure is available from E.I. duPont de Nemours & Co. of Wilmington, Del. The vacuum panels 62 provide very efficient thermal insulation, typically on the order of about four times the insulation efficiency provided by traditional thermal insulation materials.

To form the vacuum panels 62 at low cost, the barrier film 66 is not molded to fit around the porous medium 64 but rather is provided as sheet material with edges 72 sealed together. Because a tight seal is critical, the edges 72 of the barrier film 66 may be joined together over a sealed portion which extends for ½ inch or more and at an angle to the underlying surface of the porous medium 64. In part because of the sealed portions 72 of the barrier film 66, the vacuum panels 62 do not have a smooth, uniform outer profile. Accordingly, adjacent vacuum panels 62 cannot be generally positioned without space between them. This space can lead to significant edge losses in thermal efficiency.

In one aspect of the present invention, the vacuum panels 62 are not the sole insulation between the inner liner 20 and the outer shell 22. Edges 72 of the vacuum panels 62 are covered with a compressible layer of thermal insulation, which in the preferred embodiment includes flexible sheet insulation 76 and loft material 74. The compressible layer of thermal insulation 74,76 also extends over the planar side surfaces 70 of the vacuum panels 62, i.e., between the vacuum panels 62 and the inner liner 20 and outer shell 22. The compressible layer of thermal insulation 74,76 may be placed between the vacuum panel 62 and the inner liner 20 or between the vacuum panel 62 and the outer shell 22. In the preferred embodiment, each side surface of each vacuum panel 62 is covered with a compressible layer of thermal insulation 74,76, so no vacuum panel 62 contacts either the inner liner 20 or the outer shell 22.

For example, the compressible layer of thermal insulation may be provided by about an ⅛ inch thick layer 76 of flexible open cell urethane foam. As best illustrated in FIG. 3, the insulation layer 76 is preferably wrapped around each of the vacuum panels 62. To prevent the insulation layer 76 from becoming dislodged when the vacuum panels 62 are positioned between the inner liner 20 and the outer shell 22, the compressible insulation layer 76 may be taped around the vacuum panels 62.

The compressible insulation layer may also be provided by a loft material 74 having a significant loft. In the preferred embodiment, the loft material 74 is a non-woven web comprised of 5.5 denier polyester fiber with a silicone finish and no binder. Either the loft material 74 or the flexible sheet insulation 76 may be used by itself to provide the desired compressible insulation layer 74,76. However, in the preferred embodiment loft material 74 is used in conjunction with the flexible sheet insulation 76. In particular, a blanket of loft material 74 is positioned over the vacuum panel 62 for the base 16, extending under the vacuum panels 62 for the side walls 14.

The container 10 of the present invention provides thermal efficiency not previously attainable. The believed mechanism for the increase in thermal efficiency is further described with reference to FIG. 4. FIG. 4 includes arrows indicating thermal flow associated with the container 10 of the present invention. While the container 10 described herein is intended primarily for maintaining cold items, the present invention is equally applicable to maintaining items within the container 10 at an elevated temperature above ambient. The thermal flow depicted in FIG. 4 can thus be the flow of heat or the flow of cold.

Arrows A indicate the thermal flow through the vacuum panels 62. Because the vacuum panels 62 provide very efficient thermal insulation, thermal flow A outward through the vacuum panels 62 is minimal. Edge loss associated with thermal flow outward between adjacent vacuum panels 62 is illustrated with arrows B. Adjacent vacuum panels 62 cannot be spaced closely enough to eliminate edge loss B, particularly with the spacing between vacuum panels 62 caused by the sealed edges 72 of the barrier film 66. The presence of the compressible insulation layer 72 in the space between vacuum panels 62, including both the flexible sheet 76 and the loft material 74, significantly reduces edge loss B. Even with this reduction, edge loss B likely dominates over thermal loss A through the vacuum panels 62.

Arrows C indicate thermal flow along the vacuum panels 62 between the vacuum panels 62 and the inner liner 20. Arrows D indicate thermal flow along the vacuum panels 62 between the vacuum panels 62 and the outer shell 22. The compressible insulation layer 74,76 running along the side surfaces 70 of the vacuum panels 62 significantly reduces thermal flows C and D. Thermal flows C and D run around the cold source within the container 10, rather than toward or away from it. Nonetheless, thermal flows C and D are believed significant in the overall thermal efficiency of the container 10, because thermal flows C and D contribute to the edge loss B. The compressible insulation layer 74,76 disposed along the side surfaces 70 of the vacuum panels 62 provides a reproducible, consistent reduction of thermal flows C and D. To provide the maximum benefit, the compressible insulation layer 74,76 should extend along substantially all of the side surface of the vacuum panel 62. The reduction of thermal flows C and D helps to minimize edge loss B, and increases the overall thermal efficiency of the container 10.

Positioning of the loft insulation 74 in the base 16 immediately under the inner liner 20 is particularly advantageous. In manufacture of the container 10, the distance between the outer shell 22 and the inner liner 20 in the base 16 is subject to considerable manufacturing tolerance. The thickness of the vacuum panel 62 disposed in the base 16 also has manufacturing tolerance, albeit much smaller. In use of the container 10, the distance between the outer shell 22 and the inner liner 20 in the base is subject to considerable stress and variance due to temperature differences between the inside and the outside of container 10, weight of objects placed inside the container 10, weight placed on the container 10, or impacts sustained by the outer or inner surfaces. By contrast, the variance experienced by the vacuum panel 62 disposed in the base 16 is relatively less. The loft of the non-woven loft material 74 compensates for both manufacturing tolerance and movement or deformation of the inner liner 20 relative to the outer shell 22.

The flexible sheet insulation 76 also provides durability and protection to the barrier film 66 material of the vacuum panels 62, minimizing the potential for puncture and/or wear. To further protect against puncture and/or wear of the vacuum panels 62, closed end rivets 78 may be faced on the inside of the outer shell 22 with a protective layer 80. The protective layer 80 is attached to the outer shell 22 to cover and smooth the closed end rivets 78. The protective layer 80 may be a formed of the same material as the outer shell 22, or of a different material. The protective layer 80 may be heat sealed to the outer shell 22, or may be adhesively joined to the outer shell 22 such as in a pressure sensitive tape. The protective layer 80 also further assists in providing a water-tight seal for the thermal insulation 24.

As shown in FIGS. 2 and 3, thermal insulation is also placed inside the dam 48. The dam 48 could be insulated with a smaller vacuum panel, however, the potential for edge loss between the small vacuum panel for the dam 48 and the larger vacuum panel 62 for the lid 18. detracts from any thermal efficiency gained by using a vacuum panel in the dam 48. In the preferred embodiment, the dam 48 is insulated with a strip 84 of compressible, open cell foam. The strip of foam 84 is sized slightly larger than the depth of the dam 48, so the placement of the vacuum panel 62 for the lid 18 ensures a tight compressing fit between the dam insulation 84 and the vacuum panel 62 for the lid 18, again to minimize edge loss between the vacuum panel 62 for the lid 18 and the dam 48.

Figure 5:
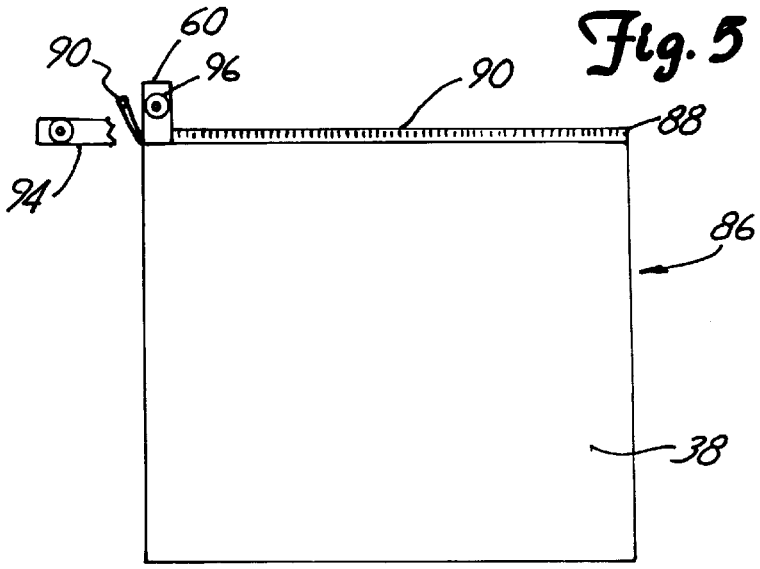
FIG. 5 is a plan view of a coolant material pouch for use in the container of FIG. 1.

FIG. 5 shows a coolant material pouch 86 which can be used with the present invention, particularly intended for use with dry ice as the coolant material. The coolant material pouch 86 is formed of an open weave nylon mesh. The open weave allows carbon dioxide to escape through the fabric, but prevents user contact with dry ice within the pouch 86.

The pouch 86 may have an openable side 88, such as having an edge with a zipper 90. A strap 92 may be used to secure the pouch 86 to the inner liner 20 and prevent undesired removal of the pouch 86 from the container 10. A lock 94 may be used for the zipper 90, or for simultaneously locking the zipper 90 closed and to lock the pouch 86 to the container 10. For instance, a magnetic release locking device 94 may be used. By fastening the magnetic release locking device 94 on the grommet 96 positioned as shown, the magnetic release locking device 94 can be used not only to secured the grommet 96 to the strap 92, but also to lock the zipper 90 in the closed position. Other types of locks may alternatively be used.

Other types of coolants including phase change materials and phase change material packets can alternatively be used in the container 10. If desired, a false floor such as of a perforated aluminum sheet may be used to prevent user access to the phase change material.

Although the present invention has been described with reference to preferred embodiments, workers skilled in the art will recognize that changes may be made in form and detail without departing from the spirit and scope of the invention.

What is claimed is:

1. An insulated container comprising:

interior wall;

exterior wall surrounding the interior wall, with a space between the interior wall and the exterior wall, the interior wall and the exterior wall defining a plurality of generally planar sides of the insulated container each planar side having a length and a width;

vacuum panels disposed in the space between the interior wall and the exterior wall, each vacuum panel having a first side toward the interior wall and a second side toward the exterior wall, with a thickness between the first side and the second side, each vacuum panel having a length and a width which exceeds the thickness, each vacuum panel extending over a substantial entirety of the length and the width of one of the planar sides of the insulated container; and compressible insulation fill in the space between the interior wall and the exterior wall, the compressible insulation fill being about as long or longer than the length of each of the planar sides and being about as wide or wider than the width of each of the planar sides such that the compressible insulation fill extends along a substantial entirety of at least one of the first and second sides of the vacuum panel, the compressible insulation fill being flexible, wherein the compressible insulation fill comprises a sheet material layer formed independently of the vacuum panel with a generally uniform thickness, the sheet material layer being individually wrapped entirely around both the first and second sides of each vacuum panel.

2. The insulated container of claim 1, wherein the sheet material layer comprises a foam sheet material layer.

3. The insulated container of claim 2, wherein the container comprises a floor, peripheral sides extending from the floor to together with the floor form an enclosure with an opening, and a lid which covers the opening, wherein each of the floor, peripheral sides and lid includes a separate vacuum panel disposed between interior wall and exterior wall, wherein the compressible insulation fill further comprises a loft insulation material extending along a substantial entirely of at least one side of the vacuum panel for the floor.

4. The insulated container of claim 1, wherein the compressible insulation fill comprises a loft insulation material.

5. The insulated container of claim 1, wherein the container comprises a floor, peripheral sides extending from the floor which together with the floor form an enclosure with an opening, and a lid which covers the opening, wherein each of the floor, peripheral sides and lid includes a separate vacuum panel disposed between interior wall and exterior wall, wherein the thickness of the vacuum panels nearly matches the space between the interior wall and the exterior wall of about one inch or greater, and wherein the compressible insulation fill is about ⅛th of an inch thick.

6. The insulated container of claim 1, wherein the interior wall and the exterior wall are formed of a generally rigid material.

7. The insulated container of claim 6, wherein the interior wall and the exterior wall have adjoining edges welded together with a bead to encase the vacuum panel in a water-tight manner, and wherein the interior wall, the exterior wall and the bead and are formed of thermoplastic materials having the same or similar coefficients of thermal expansion.

8. The insulated container of claim 1, wherein the container comprises a floor, peripheral sides extending from the floor which together with the floor form an enclosure with an opening, and a lid which mates with the peripheral sides to cover the opening, wherein the interior wall of both the floor and the peripheral sides is provided by an inner liner integrally formed of a single deep drawn sheet of material.

9. The insulated container of claim 1, wherein the container comprises a floor, peripheral sides extending from the floor which together with the floor form an enclosure with an opening, and a lid which mates with the peripheral sides to cover the opening, wherein the lid comprises a dam received in the opening, and a compressible gasket extending peripherally outward from the dam to seal against a top edge of the peripheral sides of the insulated container, the compressible gasket having an opening to permit pressure release from the container.

10. The insulated container of claim 1, wherein the vacuum panel comprises:

a porous space retainer, evacuated below atmospheric pressure; and a sheet of flexible hermetic film sealed around the evacuated porous space retainer with sealed edge portions which extend an an angle to an underlying surface of the porous space retainer.

11. The insulated container of claim 1, wherein the interior wall defines an enclosure, further comprising:

a coolant containment structure disposed within the enclosure for enclosing dry ice, the coolant containment structure having a plurality of openings of a size permitting coolant vapor flow but preventing user contact with dry ice within the coolant containment structure.

12. The insulated container of claim 11, wherein the coolant containment structure is a dry ice containment structure comprising a pouch formed of an open weave fabric.

13. The insulated container of claim 11, wherein the coolant containment structure is closable and removably secured to the interior wall with a lock to prevent unauthorized access to coolant within the coolant containment structure.

14. The insulated container of claim 1, wherein the container comprises a floor, peripheral sides extending from the floor which together with the floor form an enclosure with an opening, and a lid which mates with the peripheral sides to cover the opening, and further comprising:

a handle secured to exterior wall of at least one of the peripheral sides and the lid with a first attachment;

a hinge secured to exterior wall of the lid with a second attachment and to exterior wall of one of the peripheral sides with a third attachment; and protective layer disposed in the space between vacuum panel and exterior wall over the first, second and third attachments.

15. An insulated container comprising:

interior wall;

exterior wall surrounding the interior wall with a space between the interior wall and the exterior wall;

vacuum panel disposed in the space between the interior wall and the exterior wall; and compressible insulation fill wherein the compressible insulation fill comprises a foam sheet material layer formed independently of the vacuum panel with a generally uniform thickness, the foam sheet material layer being individually wrapped entirely around both the first and second sides of each vacuum panel;

wherein adjoining edges of the interior wall and the exterior wall are welded together with a bead to encase the vacuum panel in a water-tight manner; and wherein the interior wall, the exterior wall and the bead are formed of the same thermoplastic material.

16. The insulated container of claim 15, wherein the container comprises a floor, peripheral sides extending from the floor to together with the floor form an enclosure with an opening, and a lid which mates with the peripheral sides at a junction to cover the opening;

wherein the interior wall of both the floor and the peripheral sides is provided by an inner liner integrally formed of a single deep drawn sheet of material; and wherein the inner liner comprises a top edge which extends peripherally over vacuum panel edges such that the bead is disposed outside the junction between the enclosure and the lid.

17. An insulated container comprising:

interior wall defining an enclosure;

exterior wall surrounding the interior wall, with a space between the interior wall and the exterior wall;

vacuum panel disposed in the space between the interior wall and the exterior wall;

compressible insulation fill wherein the compressible insulation fill comprises a foam sheet material layer formed independently of the vacuum panel with a generally uniform thickness, the foam sheet material layer being individually wrapped entirely around both the first and second sides of each vacuum panel; and a coolant containment structure disposed within the enclosure for enclosing dry ice, the coolant containment structure having a plurality of openings of a size permitting coolant vapor flow but preventing user contact with dry ice within the coolant containment structure.

18. The insulated container of claim 17, wherein the coolant containment structure is a dry ice containment structure comprising a pouch formed of an open weave fabric.

19. The insulated container of claim 17, wherein the coolant containment structure is closable and removably secured to the interior wall with a lock to prevent unauthorized access to coolant within the coolant containment structure.

20. The insulated container of claim 17, wherein the container comprises a floor, peripheral sides extending from the floor which together with the floor form an enclosure with an opening, and a lid which mates with the peripheral sides to cover the opening, wherein the lid comprises a dam received in the opening, and a compressible gasket extending peripherally outward from the dam to seal against a top edge of the peripheral sides of the insulated container, the compressible gasket having an opening to permit pressure release from the container.

* * * * *

UNITED STATES PATENT AND TRADEMARK OFFICE

CERTIFICATE OF CORRECTION

PATENT NO. : 6,244,458 B1 
DATED : June 12, 2001
INVENTOR(S) : Clinton Frysinger et al.

It is certified that error appears in the above-identified patent and that said Letters Patent is hereby corrected as shown below:

Title page,
Item [56], References Cited, U.S. PATENT DOCUMENTS, insert -- 2,768,046 10-23-56 Evans D.W. --
OTHER PUBLICATIONS, insert -- "Dow INSTILL Vacuum Insulation Core: The Ultimate Filler for Vacuum Insulation Systems", a Dow Chemical Company presentation, November 19, 1997.
Brochure: "Optimizing Vacuum Insulation Panel Performance Using INSTILL Vacuum Insulation Core: A Design Guide for Fabricators and OEMs", September, 1998.
Brochure: "INSTILL Vacuum Insulation Core: A Thinner, More Efficient Insulating Solution", November 1999. --

Signed and Sealed this

Eighth Day of October, 2002

*Attest:*

*Attesting Officer*

JAMES E. ROGAN
*Director of the United States Patent and Trademark Office*